US008653352B2

(12) United States Patent
Wauke

(10) Patent No.: US 8,653,352 B2
(45) Date of Patent: Feb. 18, 2014

(54) VIBRATION GENERATOR

(75) Inventor: Tomokuni Wauke, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 13/605,640

(22) Filed: Sep. 6, 2012

(65) Prior Publication Data

US 2013/0061736 A1 Mar. 14, 2013

(30) Foreign Application Priority Data

Sep. 9, 2011 (JP) ..... 2011-196756

(51) Int. Cl.
*G10H 7/00* (2006.01)

(52) U.S. Cl.
USPC ..... 84/616; 84/654

(58) Field of Classification Search
USPC ..... 84/616, 654
See application file for complete search history.

(56) References Cited

U.S. PATENT DOCUMENTS 3,689,709 A * 9/1972 Salmansohn et al. ..... 381/151
4,064,376 A * 12/1977 Yamada ..... 381/152
4,779,615 A * 10/1988 Frazier ..... 601/47
4,989,605 A * 2/1991 Rossen ..... 607/46
5,101,810 A * 4/1992 Skille et al. ..... 601/47
5,437,608 A * 8/1995 Cutler ..... 601/49
5,807,287 A * 9/1998 Cheng ..... 601/60
5,951,500 A * 9/1999 Cutler ..... 601/47
6,027,463 A * 2/2000 Moriyasu ..... 601/46
6,104,820 A * 8/2000 Soza ..... 381/151
6,120,468 A * 9/2000 Tseng ..... 601/46
6,369,312 B1 * 4/2002 Komatsu ..... 84/723
7,189,211 B2 * 3/2007 Inada et al. ..... 601/47
7,253,350 B2 * 8/2007 Noro et al. ..... 84/600
7,301,094 B1 * 11/2007 Noro et al. ..... 84/645
7,553,288 B2 * 6/2009 Cohen ..... 601/47
7,605,320 B2 * 10/2009 Le et al. ..... 84/464 R
7,749,178 B2 * 7/2010 Imboden et al. ..... 601/15
7,815,582 B2 * 10/2010 Imboden et al. ..... 601/15
7,909,785 B2 * 3/2011 Podrazhansky et al. ..... 601/46
7,918,308 B2 * 4/2011 Cohen ..... 181/150
7,938,789 B2 * 5/2011 Imboden et al. ..... 601/46
8,436,241 B2 * 5/2013 Yamashita et al. ..... 84/611
8,463,389 B1 * 6/2013 Oths ..... 607/46
2004/0139842 A1 * 7/2004 Brenner et al. ..... 84/477 R
2005/0070241 A1 * 3/2005 Northcutt et al. ..... 455/265
2005/0083314 A1 * 4/2005 Shalit et al. ..... 345/179
2009/0189748 A1 * 7/2009 Bergere ..... 340/407.1
2009/0216352 A1 * 8/2009 Glebe et al. ..... 700/94
2010/0005951 A1 * 1/2010 Le et al. ..... 84/464 R (Continued)

FOREIGN PATENT DOCUMENTS

JP 2001-121079 5/2001

*Primary Examiner* — David S. Warren
(74) *Attorney, Agent, or Firm* — Brinks Gilson & Lione

(57) ABSTRACT

From analog music information in which the sounds of a plurality of musical instruments are mixed, sound data corresponding to the register of the reproduced sound of a bass guitar and sound data corresponding to the register of the reproduced sound of a drum are extracted using a band-pass filter. A drive pulse with a low frequency is generated within the periods of data sections in which the former sound data reaches a predetermined level or higher, and a drive pulse with a high frequency is generated within the periods of data sections in which the latter sound data reaches a predetermined level or higher. A vibrating body in a vibration mechanism unit is resonated by two drive pulses with frequencies, thereby causing vibration according to the reproduced sound of music.

14 Claims, 10 Drawing Sheets

(56) References Cited

U.S. PATENT DOCUMENTS

2011/0029106 A1* 2/2011 Isberg et al. ..... 700/94
2011/0064251 A1* 3/2011 Siotis ..... 381/191
2011/0248817 A1* 10/2011 Houston et al. ..... 340/4.2
2012/0179077 A1* 7/2012 Tuck et al. ..... 601/46
2012/0271441 A1* 10/2012 Zhang et al. ..... 700/94
2013/0061736 A1* 3/2013 Wauke ..... 84/736
2013/0162178 A1* 6/2013 Evans ..... 318/114

* cited by examiner

VIBRATION GENERATOR

CLAIM OF PRIORITY

This application claims benefit of Japanese Patent Application No. 2011-196756 filed on Sep. 9, 2011, which is hereby incorporated by reference in its entirety.

BACKGROUND

1. Field of the Disclosure

The present disclosure relates to a vibration generator that can generate vibration by rhythm in accordance with music information.

2. Description of the Related Art

Japanese Unexamined Patent Application Publication No. 2001-121079 discloses an apparatus for driving a vibration source that generates melodies as sound when a mobile telephone gets an incoming call and generates vibration corresponding to the ringtone melodies.

The apparatus for driving a vibration source is an apparatus configured to extract, by a low-pass filter, low-pass components from a music signal and generate vibration using the signal of the low-pass components. As a mechanism for generating vibration, the signal of the low-pass components is amplified by an amplifier, thereby driving a DC motor. A weight is eccentrically provided in the rotary shaft of the DC motor, and vibration is generated by rotating the rotary shaft. Alternatively, vibration is generated using low-pass components of a music signal using a vibration speaker.

The apparatus for driving a vibration source disclosed in Japanese Unexamined Patent Application Publication No. 2001-121079 is an apparatus for producing vibration by using low-pass components of a music signal. For this reason, when music data, such as ringtone melodies of a mobile telephone, composed of simple scales not accompanying the sound of accompaniment or a percussion instrument is used as a sound source, it may be possible to generate vibration in accordance with reproduced music by extracting a lower register from the music signal. However, when music information, such as music information obtained by recording live music, in which music data of a plurality of musical instruments is mixed is used as a sound source, low-pass components of sound data of a plurality of musical instruments are left in a mixed manner even after the low-pass components are extracted therefrom, and thus, it is difficult to effectively generate a rhythm of the reproduced sound of music using vibration.

In addition, when the vibration generating source is a DC motor, it is difficult to generate vibration in accordance with a detailed rhythm of the music information.

Japanese Unexamined Patent Application Publication No. 2001-121079 also discloses generating the reproduced sound of music and vibration from the same vibration speaker. This method may be possible when simple melodies such as ringtone melodies of a mobile telephone serve as the sound source, but when music information in which sound data of a plurality of musical instruments is mixed serves as the sound source, it is difficult to generate a rhythm using vibration in accordance with the reproduced sound of music in which the sounds of the plurality of musical instruments are mixed.

SUMMARY

A vibration generator is provided with a vibration mechanism unit including a vibrating body having a predetermined mass, an elastic support member supporting the vibrating body, and a drive unit exerting a vibration force on the vibrating body, and with a drive circuit unit driving the vibration mechanism unit. The drive circuit unit includes a sound data extraction unit extracting sound data of any musical instrument from music information in which sound data of a plurality of musical instruments is mixed, a section extraction unit extracting, from the extracted sound data, a data section in which a level is equal to or higher than a predetermined value or exceeds the predetermined value, and a pulse conversion unit outputting, during the extracted data section, a drive pulse of a certain frequency for driving the vibrating body at a natural vibration frequency or at a vibration frequency approximate thereto.

The vibration generator of the invention may extract sound data of any musical instrument from music information in which sound data of a plurality of musical instruments is mixed, and generate vibration by detecting the level of the sound data. For this reason, by retrieving data of a predetermined musical instrument such as a drum and a bass guitar from the music information including the sound of percussion instruments or accompaniment obtained by recording, for example, live music, it is possible to generate vibration corresponding to the emitted sound of the musical instrument.

In addition, since, in a data section extracted from the sound data of any musical instrument, a drive pulse of a constant frequency for driving a vibrating body at a natural vibration frequency or at a vibration frequency approximate to the natural vibration frequency is generated, it is possible to generate rhythmical extensive vibration in a vibration mechanism unit in accordance with sound data of the selected musical instrument.

The present invention can be configured to have a plurality of vibration mechanism unit, and in each of the vibration mechanism unit, vibrating bodies may vibrate at different natural vibration frequencies.

DESCRIPTION OF THE EXEMPLARY EMBODIMENTS

Figure 1:
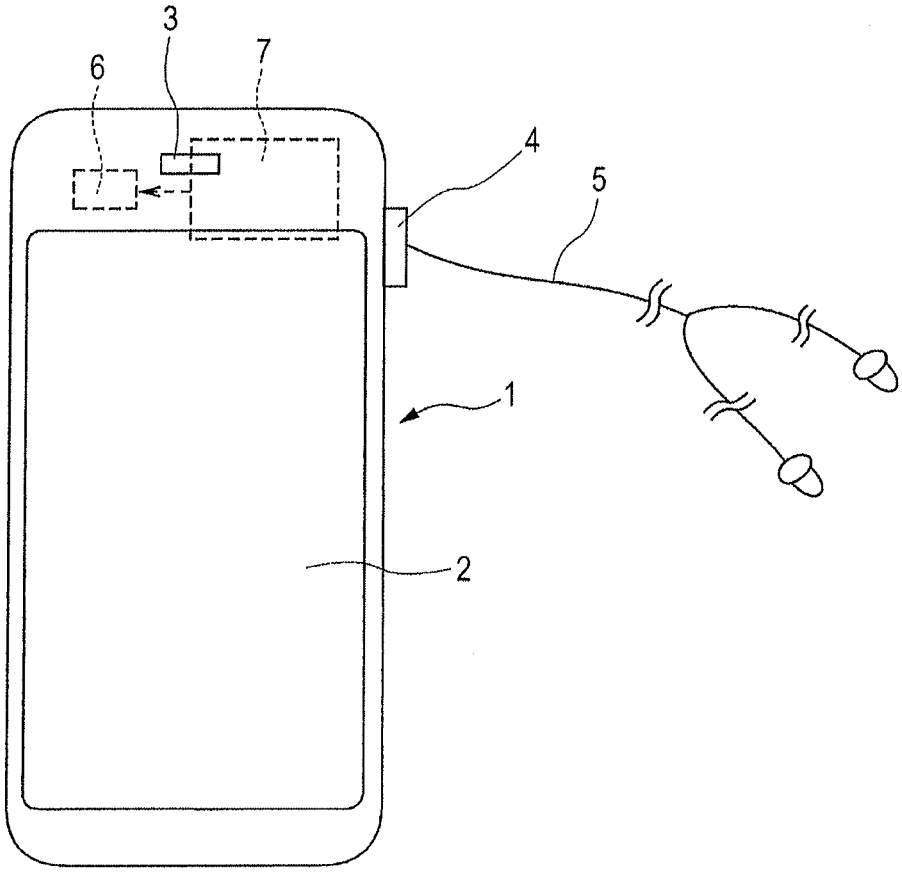
FIG. 1 is an illustrative diagram of a portable audio device in which a vibration generator is included according to an embodiment of the present invention.

A portable audio device 1 shown in FIG. 1 is provided with a screen 2 as a display in the case and a sound emission unit 3 that includes a speaker above the screen. In one side of the case of the portable audio device 1, an audio output unit 4 is provided, and the audio output unit 4 is connected to earphones 5. Music information is reproduced from either of the speaker provided in the sound emission unit 3 or the earphones 5.

Inside the case of the portable audio device 1, a vibration mechanism unit 6 and a drive circuit unit 7 for driving the vibration mechanism unit 6 are included.

FIGS. 2 to 6B show an example of the vibration mechanism unit 6. The vibration mechanism unit 6 can perform a vibration operation at two natural vibration frequencies.

Figure 2:
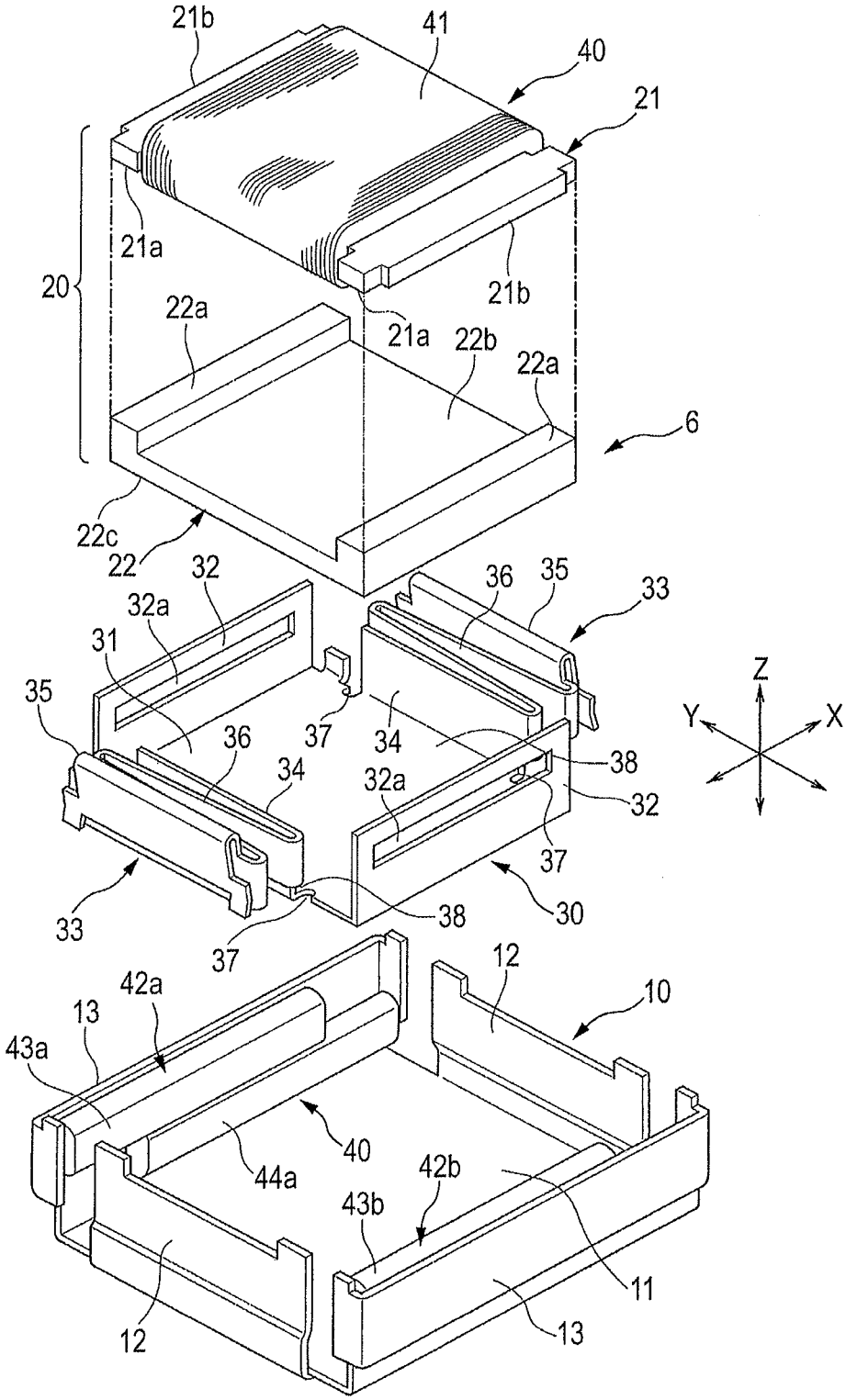
FIG. 2 is an exploded perspective view of a vibration mechanism unit used in the vibration generator according to the embodiment of the invention.

As shown in FIG. 2, the vibration mechanism unit 6 includes a housing 10, a vibrating body 20, a support 30 that holds the vibrating body 20, and an elastic support member 33 that supports the vibrating body 20 and the support 30 inside the housing 10. Between the housing 10 and the vibrating body 20, the support 30 is provided.

As shown in FIG. 2, the housing 10 is formed, as a single body, with a bottom plate part 11, a pair of fixing plate parts 12 and 12 that are vertically folded from the bottom plate part 11 and face each other in the X direction, and a pair of magnet support plate parts 13 and 13 that are vertically folded from the bottom plate part 11 and face each other in the Y direction.

The vibrating body 20 includes a magnetic core 21 and a magnetic yoke 22. The magnetic core 21 is formed of a magnetic metal material in a plate shape, and around the magnetic core, a coil 41 constituting a magnetic drive unit 40 is provided. The coil 41 is configured such that a fine copper line is wound around the magnetic core 21 multiple times.

The magnetic yoke 22 is formed of the same magnetic metal material as that of the magnetic core 21. The magnetic yoke 22 has a concave part 22*b* formed in the center thereof, and has upward connection faces 22*a* and 22*a* that sandwich the concave part 22*b* in both sides of the Y direction. When the magnetic core 21 is superimposed on the magnetic yoke 22, the lower half of the coil 41 is accommodated in the concave part 22*b*, downward connection faces 21*a* and 21*a* of protruding parts protruding from the coil 41 of the magnetic core 21 are connected to the connection faces 22*a* and 22*a* of the magnetic yoke 22 in an overlapping manner, and fixed thereto by an adhesive, or the like.

The support 30 that supports the vibrating body 20 is formed by folding a plate spring material. For example, the housing 10 is formed a plate-like magnetic material such as an ion string, and support 30 is formed of a non-magnetic metal plate such as stainless steel. The support 30 includes a support bottom part 31 and a pair of facing plate parts 32 and 32 that are vertically folded from the support bottom part 31 and face each other in the Y direction. Each of the facing plate parts 32 and 32 respectively has opening parts 32*a* and 32*a* formed in an elongated shape directing to the X direction.

Figure 3:
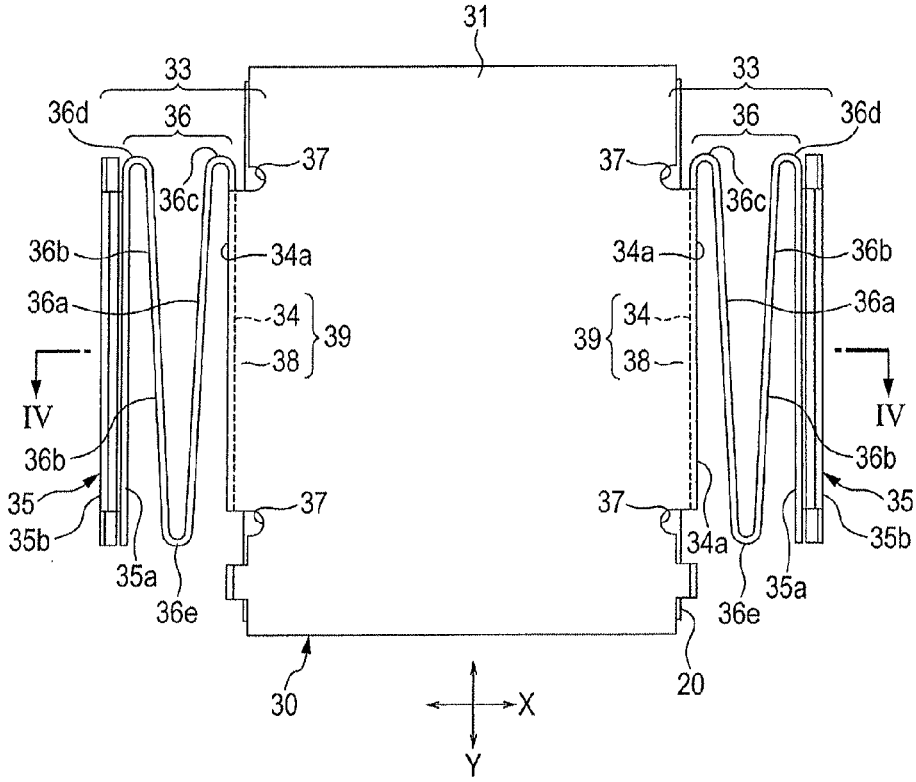
FIG. 3 is a bottom view showing a vibrating body and an elastic support member of the vibration mechanism unit shown in FIG. 2.
Figure 4:
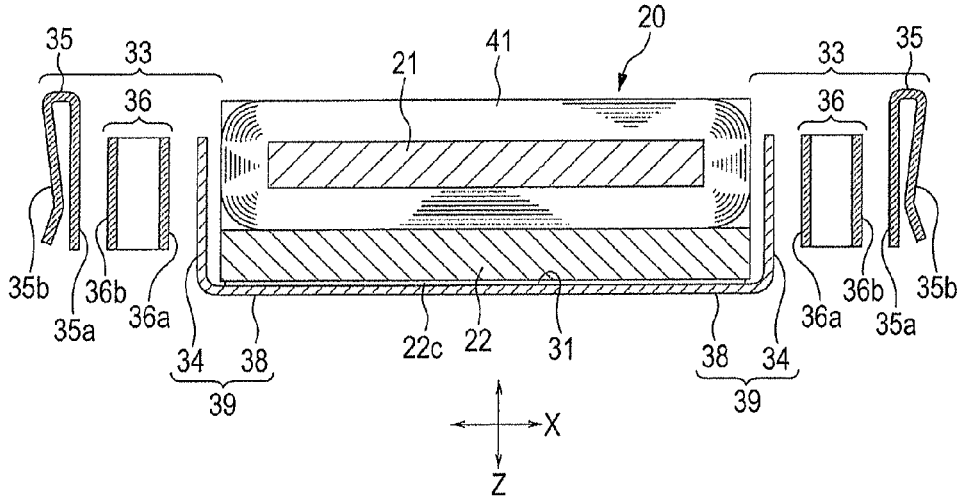
FIG. 4 is a cross-sectional view taken across the line IV-IV of FIG. 3.

As shown in FIGS. 3 and 4, the vibrating body 20 is mounted on the support 30. As shown in FIG. 2, the magnetic core 21 is formed, as a single body, with protruding end parts 21*b* and 21*b* protruding further to the Y direction than the connection faces 21*a* and 21*a*, and the protruding end parts 21*b* and 21*b* are fitted to the opening parts 32*a* and 32*a* of the facing plate parts 32 and 32 so that the vibrating body 20 is positioned and fixed to the support 30.

The support 30 includes elastic support members 33 and 33 that are formed in both sides of the X direction and continue from the support bottom part 31.

As shown in FIGS. 2 and 3, the elastic support member 33 that projects from the support bottom part 31 to one side of the X direction and the other elastic support member 33 that protrudes to the other side of the X direction are in a plan-symmetric structure interposing the Y-Z planes.

Figure 5:
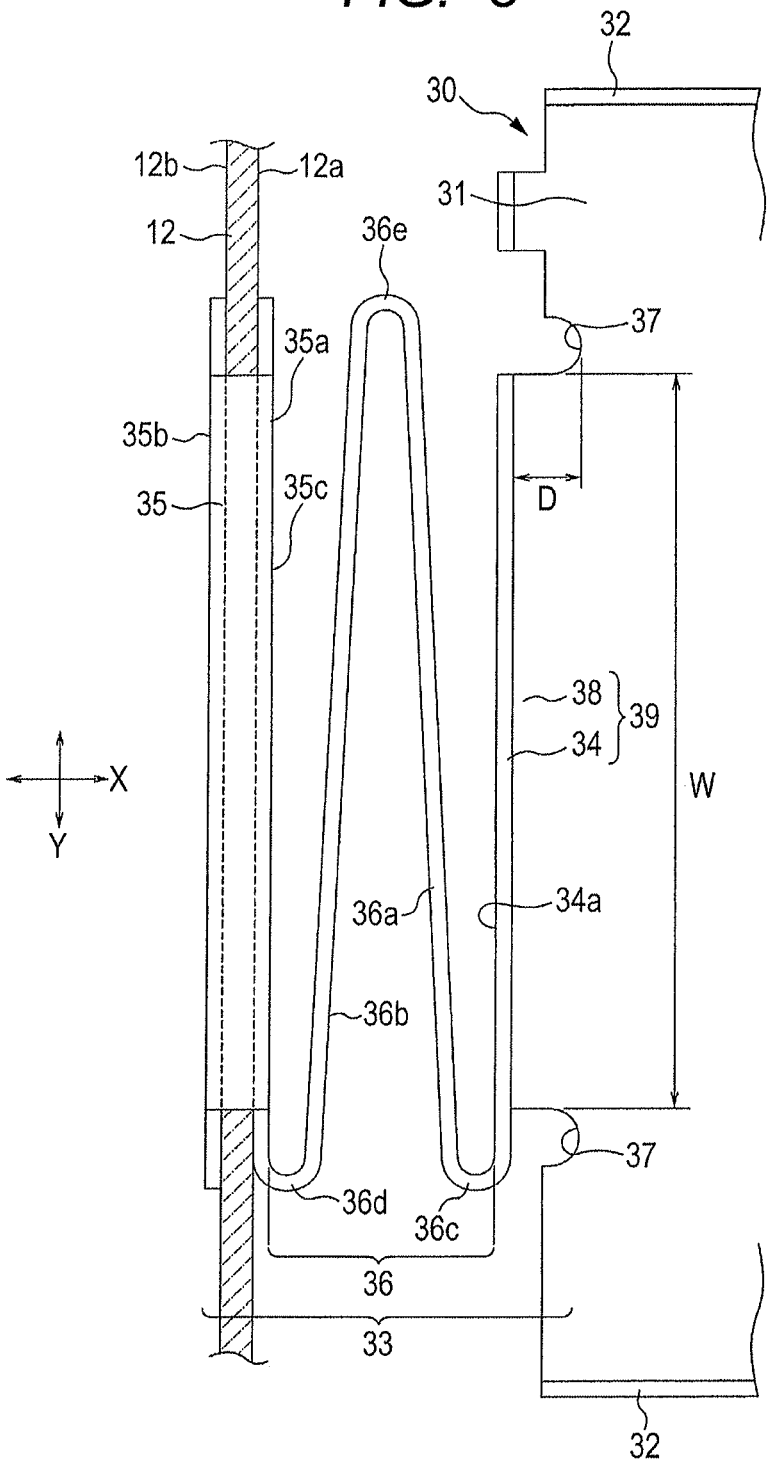
FIG. 5 is an enlarged plan view of the elastic support member.

As shown in FIG. 5 in an enlarged manner, the elastic support member 33 has an intermediate plate part 34. As shown in FIG. 4, the intermediate plate part 34 is formed by being folded vertically upward in the Z direction from a side part directing to the X direction of the support bottom part 31 of the support 30. In FIG. 5, the length dimension of the intermediate plate part 34 in the Y direction is indicated by W.

The elastic support member 33 is provided with a catching part 35 at a position outwardly apart from the intermediate plate part 34 in the X direction. As shown in FIG. 4, the catching part 35 is formed, as a single body, with a holding plate part 35*a* that is parallel to the intermediate plate part 34 and an elastic holding piece 35*b* that is bent so as to face the holding plate part 35*a*. As shown in FIG. 5, the fixing plate part 12 of the housing 10 is interposed between the holding plate part 35*a* and the elastic holding piece 35*b*. At this moment, the holding plate part 35*a* tightly contacts the inner face 12*a* of the fixing plate part 12 and the elastic holding piece 35*b* presses the outer face 12*b* of the fixing plate part 12 so that the catching part 35 is fixed to the fixing plate part 12.

As shown in FIG. 5, the outer face 34*a* of the intermediate plate part 34 and the inner face 35*c* of the holding plate part 35*a* are parallel to each other, and a first elastic deforming part 36 is provided therebetween. The first elastic deforming part 36 is formed, as a single body, with the intermediate plate part 34 and the holding plate part 35*a* as a plate spring member constituting the support 30.

The first elastic deforming part 36 includes two deforming plate parts 36*a* and 36*b*. The deforming plate parts 36*a* and 36*b* are in a band plate shape in which the length dimension in the Y direction is greater than the width dimension in the Z direction. With regard to the deforming plate parts 36*a* and 36*b*, the plate thickness direction is directed to the X direction, the width direction to the Z direction, and the length direction to the Y direction.

The base part of the deforming plate part 36*a* continues to the intermediate plate part 34 via a base bending part 36*c*, and the base part of the deforming plate part 36*b* continues to the holding plate part 35*a* via a base bending part 36*d*. A tip part of the deforming plate part 36*a* and a tip part of the deforming plate part 36*b* are in continuation via an intermediate bending part 36*e*.

The deforming plate part 36*a* and the deforming plate part 36*b* have bending distortion mainly in the X direction, and the curvature direction is the Y direction. The base bending part 36*c*, the base bending part 36*d*, and the intermediate bending part 36*e* have the center folding line directed to the Z direction and have bending distortion mainly in the X direction.

The first elastic deforming part 36 elastically deforms in the X direction with a first elastic modulus by bending distortion of each of the deforming plate parts 36*a* and 36*b*, and bending distortion of each of the base bending parts 36*c* and 36*d* and the intermediate bending part 36*e*. Bending stress required to exert bending distortion on the first elastic deforming part 36 in the X direction is small, and thus the first elastic modulus is a relatively small value. Due to distortion of the first elastic deforming part 36 in the X direction, the vibrating body 20 and the support 30 mounted therewith can vibrate at a first natural vibration frequency in the X direction.

The first natural vibration frequency of vibration of the vibrating body 20 in the X direction at this moment is determined based on the total mass of the vibrating body 20 and the support 30, and the first elastic modulus. Since the first elastic modulus is a relatively small value, the first natural vibration frequency is relatively low.

As shown in FIG. 5, the elastic support member 33 has cutout parts 37 and 37 formed at both end parts of the intermediate plate part 34 by cutting the support bottom part 31 of the support 30 in the X direction. In FIG. 5, the cut-in depth dimension of the cutout parts 37 and 37 is indicated by D. A plate spring member constituting the support bottom part 31 and range interposed by the cutout parts 37 and 37, that is, a plate spring portion surrounded by the width dimension W and the cut-in depth dimension D in FIG. 5 constitutes a deforming plate part 38. The deforming plate part 38 is fixed to the lower face 22*c* of the magnetic yoke 22 constituting the vibrating body 20 by an adhesive, or the like. The deforming plate part 38 and the intermediate plate part 34 being folded from the deforming plate part 38 constitute a second elastic deforming part 39.

When the vibrating body 20 and the support 30 vibrate in the Z direction, the second elastic deforming part 39 elastically deforms. The main deforming portion of the second elastic deforming part 39 is the deforming plate part 38, and bending distortion arises in the deforming plate part 38 in the Z direction due to the movement of the vibrating body 20 and the support 30 in the Z direction. At this moment, bending distortion also arises in the bending boundary portion between the intermediate plate part 34 and the deforming plate part 38.

The deforming plate part 38 that is the main deforming portion of the second elastic deforming part 39 is long in the Y direction that is the width direction and short in the X direction that is the curvature direction when bending occurs. For this reason, a second elastic modulus when the vibrating body 20 and the support 30 vibrate in the Z direction and the second elastic deforming part 39 bends becomes an extremely high value in comparison to the first elastic modulus of the first elastic deforming part 36 in the X direction. A second natural vibration frequency when the vibrating body 20 and the support 30 vibrate in the Z direction is determined based on the total mass of the vibrating body 20 and the support 30 and the second elastic modulus. The second natural vibration frequency is higher than the first natural vibration frequency.

If the cut-in depth dimension D of the cutout parts 37 and 37 is changed, the length dimension of the deforming plate part 38 in the X direction changes, thereby changing the second elastic modulus. Therefore, by changing the cut-in depth dimension D, it is possible to adjust the second natural vibration frequency in the Z direction that is the second direction of the vibrating body 20 and the support 30.

As shown in FIG. 2, a pair of magnet support plate parts 13 and 13 facing each other in the Y direction are provided in the housing 10. On the inner face of one magnet support plate part 13, a magnetic field generating member 42*a* constituting the magnetic drive unit 40 as well as the coil 41 is fixed, and on the inner face of the other magnet support plate part 13, a magnetic field generating member 42*b* constituting the magnetic drive unit 40 with the coil 41 in the same manner is fixed.

Figure 6A:
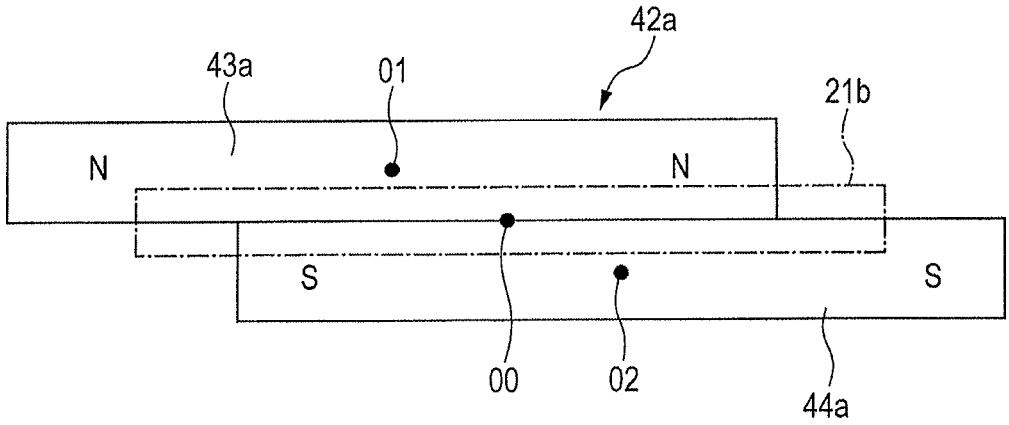
FIGS. 6A and 6B are illustrative diagrams showing the arrangement of magnets of a magnetic drive unit.

As shown in FIG. 6A, one magnetic field generating member 42*a* has an upper magnet 43*a* located in the upper side and a lower magnet 44*a* located in the bottom plate part 11 side. Both of the upper magnet 43*a* and the lower magnet 44*a* are in a long rectangular shape having the length dimension in the X direction greater than the width dimension in the Z direction. The center O1 of the upper magnet 43*a* is located in the left side in FIG. 6A, and the center O2 of the lower magnet 44*a* is located in the right side in FIG. 6A. The face of the upper magnet 43*a* facing the protruding end part 21*b* of the magnetic core 21 is magnetized to the N-pole, and the face of the lower magnet 44*a* facing the protruding end part 21*b* is magnetized to the S-pole.

When the vibrating body 20 is supported to be in a neutral posture by the elastic support members 33 and 33 without being affected by an external force, the center O0 of the protruding end part 21*b* of the magnetic core 21 is located at the intermediate point in the X direction and located in the intermediate point in the Z direction between the center O1 and the center O2.

Figure 6B:
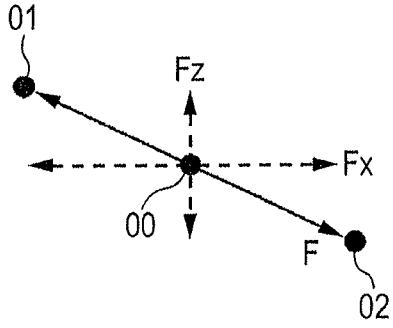

The other magnetic field generating member 42*b* facing the magnetic field generating member 42*a* shown in FIGS. 6A and 6B is in the plane-symmetric structure with the magnetic field generating member 42*a*, interposing the X-Z planes. The magnetic field generating member 42*b* has an upper magnet 43*b* that is plane-symmetric with the upper magnet 43*a* and a lower magnet 44*b* that is plane-symmetric with the lower magnet 44*a*. Furthermore, the lower magnet 44*b* is not shown in FIG. 2. The face of the upper magnet 43*b* of the magnetic field generating member 42*b* facing the protruding end part 21*b* of the magnetic core 21 is magnetized to the S-pole, and the face of the lower magnet 44*b* facing the protruding end part 21*b* is magnetized to the N-pole. In other words, the surfaces of the upper magnet 43*a* and the upper magnet 43*b* facing each other have the opposite magnetic poles to each other, and the surfaces of the lower magnet 44*a* and the lower magnet 44*b* facing each other have the opposite magnetic poles to each other.

The vibration mechanism unit 6 has two resonance modes. A first resonance mode is for vibration at the first natural vibration frequency when the vibrating body 20 and the support 30 vibrate in the X direction. A second resonance mode is for vibration at the second natural vibration frequency when the vibrating body 20 and the support 30 vibrate in the Z direction. As described above, the second natural vibration frequency is far higher than the first natural vibration frequency.

When the vibration mechanism unit 6 is driven in the first resonance mode, a first drive pulse P1 of a first frequency that matches the first natural vibration frequency or a frequency approximate thereto is imparted to the coil 41. At this moment, the frequency that changes the magnetic polarity of the surface of the protruding end part 21*b* of the magnetic core 21 to the N-pole or S-pole has a value that match the first natural vibration frequency or a value approximate thereto.

When power is supplied to the coil 41 and the protruding end part 21*b* of the magnetic core 21 functions as a magnetic polarity, a driving force F is applied to the linear direction in which the centers O1, O0, and O2 are arranged with respect to the center O0 of the protruding end part 21*b* as shown in FIG. 6B. When a driving signal is a first frequency or a frequency approximate thereto, the vibrating body 20 and the support 30 resonate in the X direction in the first resonance mode by a component force Fx of the driving force F in the X direction.

When the vibration mechanism unit 6 is driven in the second resonance mode, a second drive pulse P2 of a second frequency that matches the second natural vibration frequency or a frequency approximate thereto is imparted to the coil 41. At this moment, the vibrating body 20 and the support 30 resonate in the Z direction in the second resonance mode by a component force Fz of the driving force F in the Z direction.

For example, the first natural vibration frequency is set to around 150 to 200 Hz, and the second natural vibration frequency is set to around 400 to 600 Hz.

Since the vibration mechanism unit 6 is fixed to the inner face of the case of the portable audio device 1 shown in FIG.

1, it is possible to make a hand holding the portable audio device 1 feel vibration with the first natural vibration frequency or vibration with the second natural vibration frequency.

Figure 7:
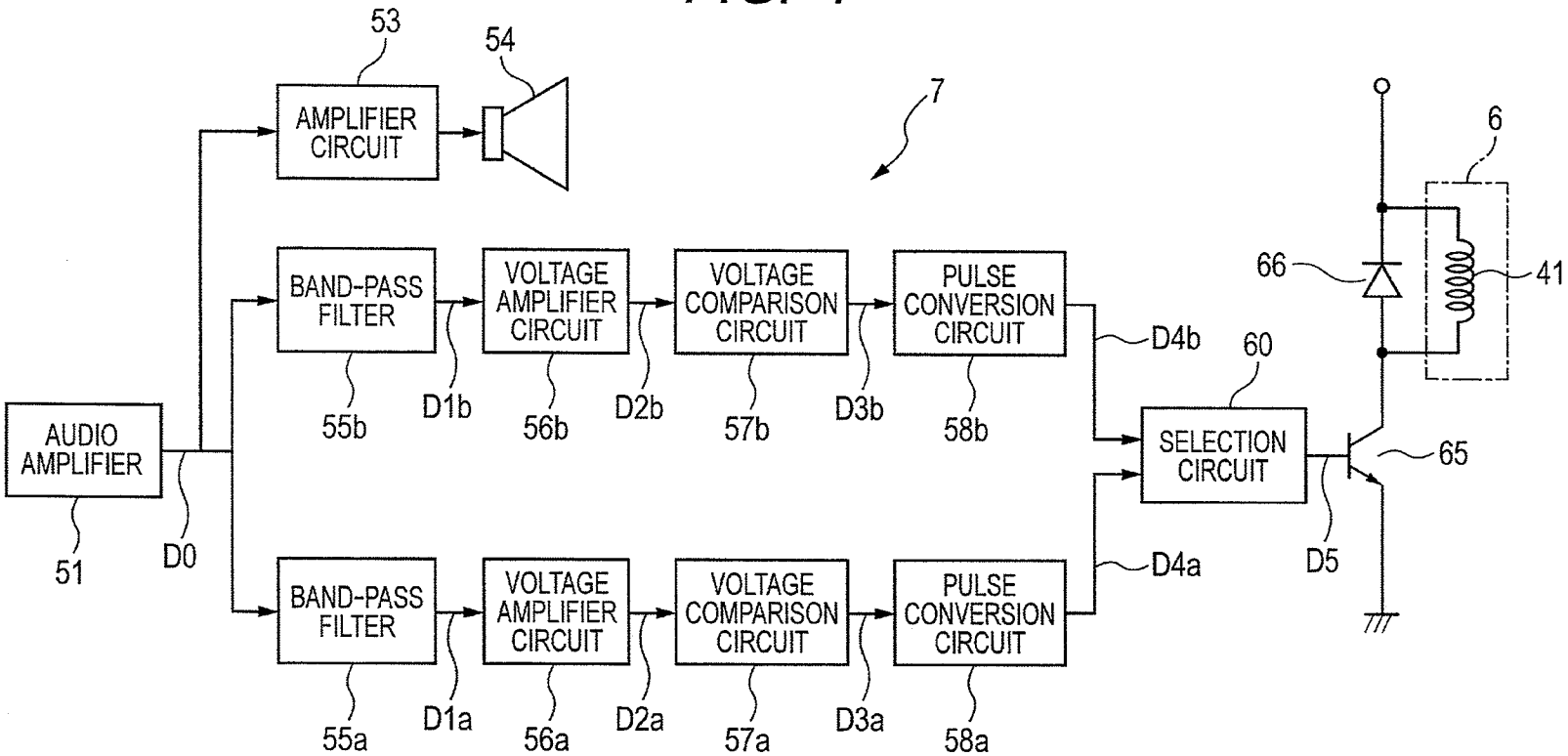
FIG. 7 is a block diagram of a drive circuit unit used in the vibration generator according to the embodiment of the invention.

In the drive circuit unit 7 shown in FIG. 7, music information D0 obtained from an audio amplifier 51 is used as a sound source. The music information D0 is information reproduced by restoring data recorded on a CD or a memory, information received from radio waves, or the like, and analog information for reproducing live music performance. The music information D0 is music information obtained by reproducing actual performance sounds of a plurality of musical instruments such as percussion instruments, stringed instruments, woodwind instruments, brass instruments and electronic instruments, and the performance sounds of the plurality of musical instruments are mixed therein. Hereinbelow, an actual performance sound of each musical instrument is called sound data.

As shown in FIG. 7, the drive circuit unit 7 is provided with an amplifier circuit 53 that amplifies the music information D0, and the reproduced sound of the music information D0 amplified by the amplifier circuit 53 is output from the speaker 54. The reproduced sound is emitted outside from the sound emission part 3 provided in the case of the portable audio device 1 shown in FIG. 1. Furthermore, when the earphones are connected to the audio output part 4 provided in the case, the reproduced sound is emitted from the earphones 5, without being output from the sound emission part 3.

In the drive circuit unit 7, the same analog music information D0 as that given to the amplifier circuit 53 is simultaneously given to two band-pass filters 55*a* and 55*b* that are sound data extraction parts. To the band-pass filter 55*a* that is a first sound data extraction part, a voltage amplifier circuit 56*a*, a voltage comparison circuit 57*a* that is a first section extraction part, and a pulse conversion circuit 58*a* that is a first pulse conversion unit are connected in order. To the band-pass filter 55*b* that is a second sound data extraction part, a voltage amplifier circuit 56*b*, a voltage comparison circuit 57*b* that is a second section extraction part, and a pulse conversion circuit 58*b* that is a second pulse conversion unit are connected in order.

Both of the pulse conversion circuits 58*a* and 58*b* are connected to a selection circuit 60 that is a selection unit, and a transistor 65 functioning as a switch part is connected to the selection circuit 60. A diode 66 and the coil 41 of the vibration mechanism unit 6 shown in FIGS. 2 to 6B are connected to each other in parallel, and power source voltage is applied to the parallel portion, and driving current is continuously supplied to the coil 41 by the switch function of the transistor 65.

Each block of the drive circuit unit 7 shown in FIG. 7 may be configured to be each individual circuit part, or may be executed based on software in a CPU of a microcomputer. In this case, the analog music information D0 obtained from the audio amplifier 51 is converted to digital values and given to the CPU. Alternatively, it may be configured such that the band-pass filters 55*a* and 55*b* perform analog processing for the music information D0, the output from the band-pass filters 55*a* and 55*b* is converted to digital values and then given to the CPU, and processing corresponding to the voltage amplifier circuits 56*a* and 56*b* and the following circuits is performed.

Next, an operation of the drive circuit unit 7 will be described based on the waveform diagram of FIG. 9.

In the analog music information D0 obtained from the audio amplifier 51, sound data of a plurality of musical instruments is mixed. In this embodiment, the music information D0 includes sound data for reproducing the sound of a bass guitar, sound data for reproducing the sound of a drum, sound data for reproducing the sound of a trumpet, sound data for reproducing the sound of an electric guitar, and the like.

Both of the band-pass filters 55*a* and 55*b* shown in FIG. 7 are for extracting sound data in a certain frequency band. By one band-pass filter 55*a*, sound data D1*a* of a bandwidth including the registry of the bass guitar is extracted from the music information D0, and by the other band-pass filter 55*b*, sound data D1*b* of a bandwidth including the registry of the drum is extracted from the music information D0.

As the band-pass filters 55*a* and 55*b*, it is preferable to use a programmable filter so as to change and set the extracted registry and bandwidth. Accordingly, it is possible to extract sound data of the band of a snare drum emitting the sound of a relatively high registry as sound data D1*a*, and to extract sound data of the band of a bass drum emitting the sound of a relatively low registry as sound data D1*b*.

In addition, the sound data is not limited to the sound data of the bass guitar or drum, and it is possible to extract sound data of other musical instruments, for example, sound data of a band in a trumpet, or an electric guitar.

The sound data D1*a* extracted by the band-pass filter 55*a* is amplified by the voltage amplifier circuit 56*a*, and the sound data D1*b* extracted by the band-pass filter 55*b* is amplified by the voltage amplifier circuit 56*b*. FIG. 9 shows waveforms of amplified data D2*a* and D2*b* obtained by amplifying the sound data D1*a* and D1*b*. In the voltage comparison circuit 57*a*, compared data D3*a* obtained by comparing the amplified data D2*a* obtained by amplifying the sound data D1*a* of the registry of the bass guitar to reference voltage S1 is obtained. The compared data D3*a* is obtained by extracting data sections Ta1, Ta2, Ta3, . . . that have higher voltage than the reference voltage S1 from the amplified data D2*a*. In the same manner, in the voltage comparison circuit 57*b*, compared data D3*b* obtained by comparing the amplified data D2*b* obtained by amplifying the sound data D1*b* of the registry of the drum to reference voltage S2 is obtained. The compared data D3*b* is obtained by extracting data sections Tb1, Tb2, Tb3, . . . that have higher voltage than the reference voltage S2 from the amplified data D2*b*.

The pulse conversion circuit 58*a* that is the first pulse conversion unit and the pulse conversion circuit 58*b* that is the second pulse conversion unit are configured with a multi vibrator, or the like.

An oscillator circuit is included in the pulse conversion circuit 58*a*, and divides the frequency of the basic oscillating pulse so as to generate a first drive pulse P1 of a constant frequency. The first drive pulse P1 is set to a frequency at which the vibration mechanism unit 6 is driven in a first resonance mode. In other words, the first drive pulse P1 is set to the first natural vibration frequency with the vibrating body 20 directed to the X direction, or a frequency at which the vibrating body 20 is made to vibrate at a vibration frequency approximate to the first natural vibration frequency.

Figure 9:
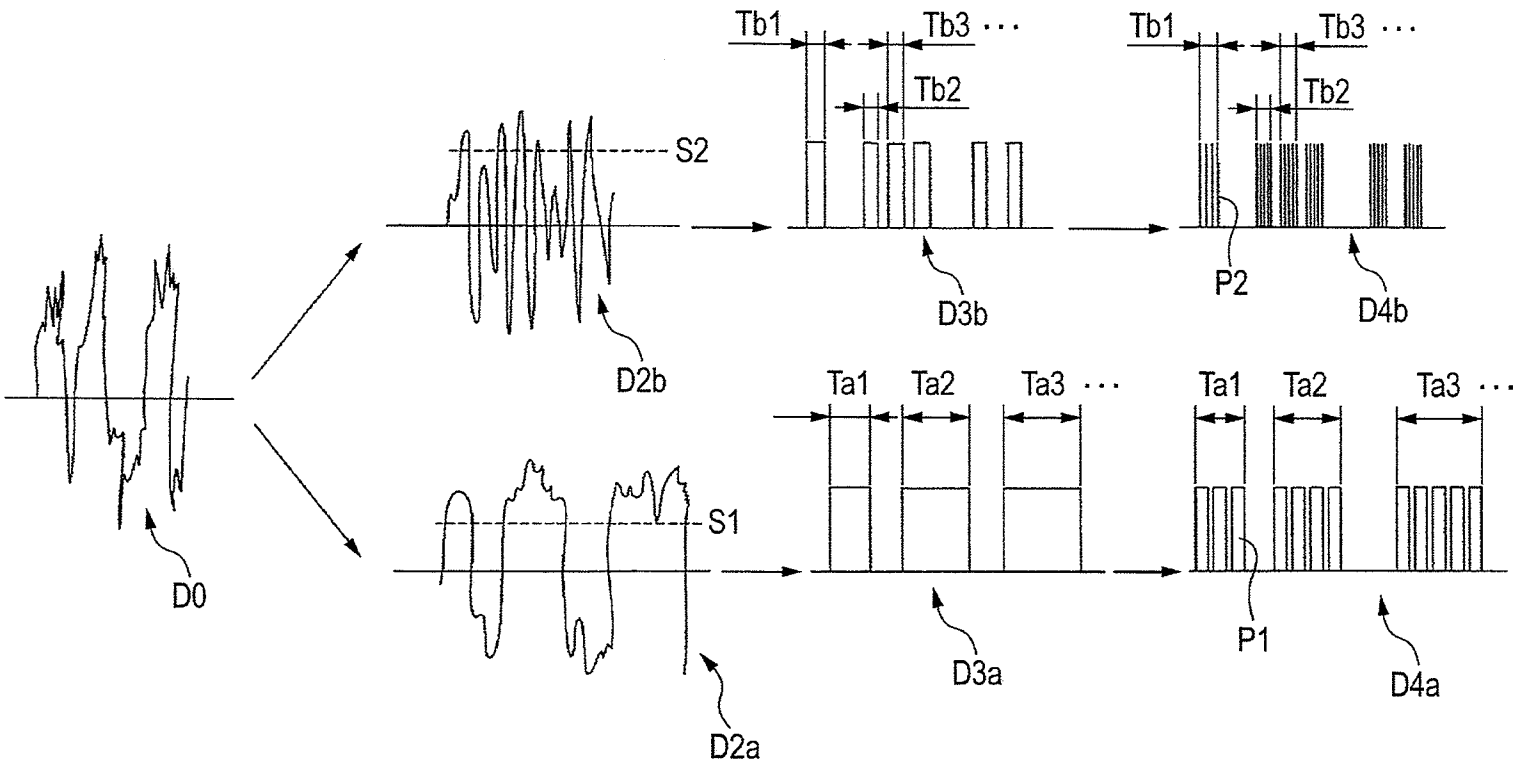
FIG. 9 is a waveform diagram showing an operation of the drive circuit unit.

As shown in FIG. 9, the pulse conversion circuit 58*a* outputs the first drive pulse P1 of a certain cycle within sections of the data sections Ta1, Ta2, Ta3, . . . extracted from the comparison data D3*a*, and the output result becomes a first driving signal D4*a*.

Another oscillator circuit included in the pulse conversion circuit 58*b* divides the frequency of the basic oscillation pulse thereby generating a second drive pulse P2. The second drive pulse P2 is set to the frequency that can drive the vibration mechanism unit 6 in the second resonance mode. In other words, the second drive pulse P2 is set to a frequency that can cause the vibrating body 20 directed to the Z direction to vibrate at the second natural vibration frequency or a vibration frequency approximate to the second natural vibration frequency.

As shown in FIG. 9, the pulse conversion circuit 58*b* outputs the second drive pulse P2 of a certain cycle within sections of the data sections Tb1, Tb2, Tb3, . . . extracted from the comparison data D3*b*, and the output result becomes a second driving signal D4*b*.

Figure 8:
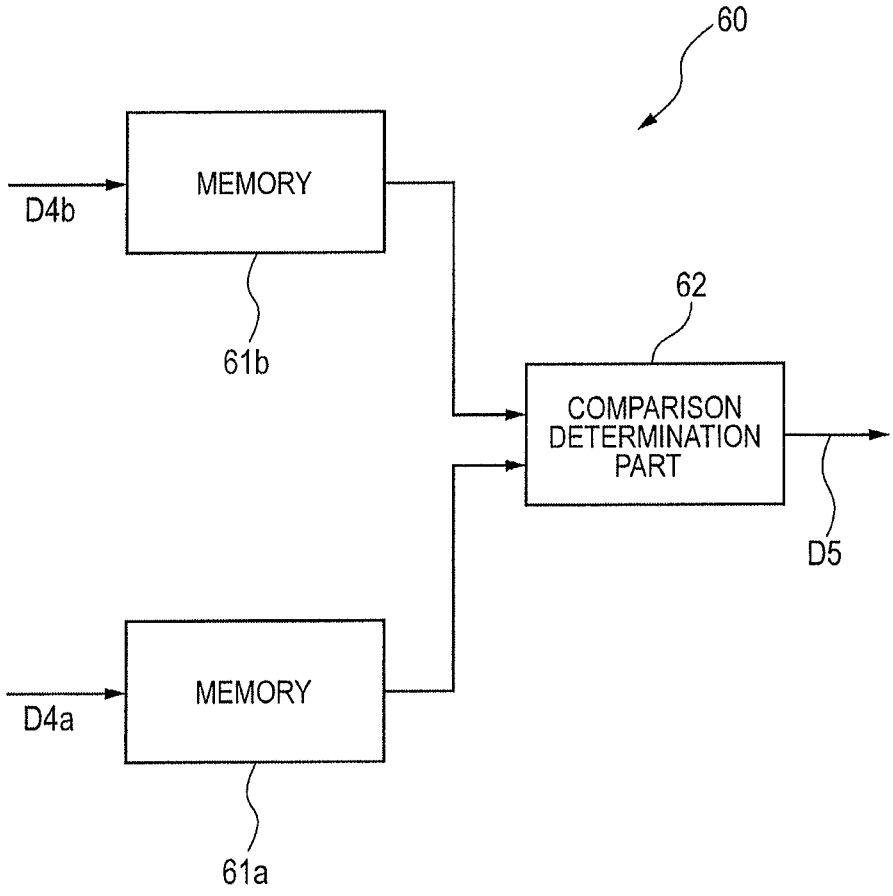
FIG. 8 is a block diagram showing a configuration example of a conversion circuit included in the drive circuit unit of FIG. 7.

As shown in FIG. 8, the selection circuit 60 that is a selection unit includes a memory 61*a* that stores the first driving signal D4*a*, a memory 61*b* that stores the second driving signal D4*b*, and a comparison determination unit 62 that compares the first driving signal D4*a* stored in the memory 61*a* to the second driving signal D4*b* stored in the memory 61*b*, and obtains complex driving signal D5 from the comparison determination unit 62.

When the first driving signal D4*a* obtained from the sound data D1*a* of the register of the bass guitar overlaps the second driving signal D4*b* obtained from the sound data D1*b* of the register of the drum in terms of time, the comparison determination unit 62 selects either of the signals. In this embodiment, the second drive pulse P2 with a high frequency is preferentially selected by the comparison determination unit 62. Furthermore, when the first driving signal D4*a* and the second driving signal D4*b* does not overlap each other in terms of time, the first driving signal D4*a* and the second driving signal D4*b* pass through the comparison determination unit 62 without change.

Figure 10A:
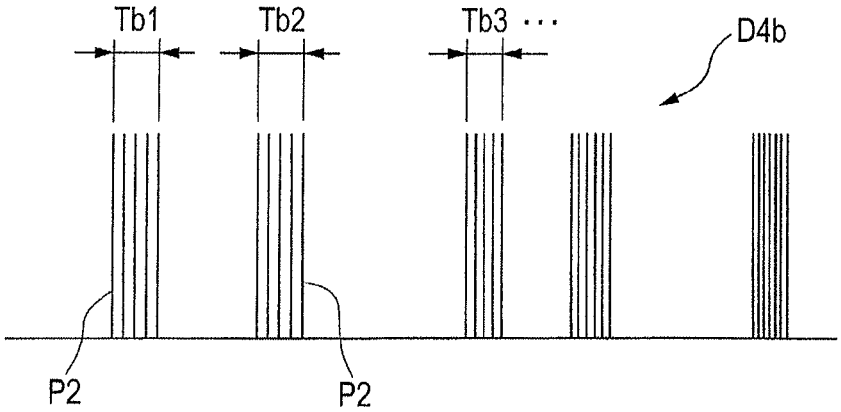
FIGS. 10A to 10C are waveform diagrams illustrating an operation of the conversion circuit.
Figure 10B:
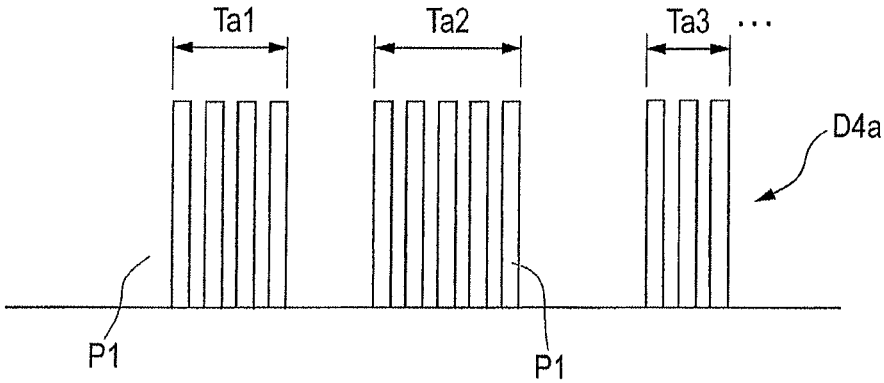
Figure 10C:
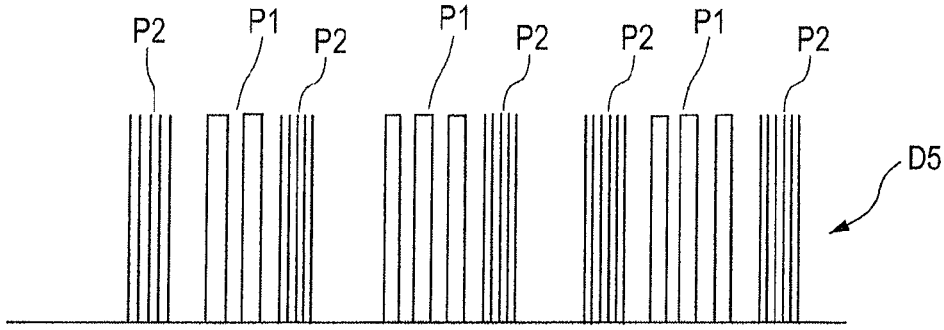

To describe in further detail, in the second driving signal D4*b*, the second drive pulse P2 is output within the periods of the data sections Tb1, Tb2, Tb3, . . . , as shown in FIG. 10A. In the first driving signal D4*a*, the first drive pulse P1 is output within the periods of the data sections Ta1, Ta2, Ta3, . . . , as shown in FIG. 10B. When the data sections Tb1, Tb2, Tb3, . . . and the data sections Ta1, Ta2, Ta3, . . . do not overlap each other in terms of time, the second driving signal D4*b* and the first driving signal D4*a* are included in the complex driving signal D5 without change.

As shown in FIG. 100, when the data sections Tb1, Tb2, Tb3, . . . and the data sections Ta1, Ta2, Ta3, . . . overlap in terms of time, the second drive pulse P2 with a high frequency is output in the complex driving signal D5 only for the overlapping time, and the first drive pulse P1 with a low frequency is not output to the data sections to which the second drive pulse P2 is given and short time sections before and after the data sections.

As shown in FIG. 7, the complex driving signal D5 obtained from the selection circuit 60 is given to the transistor 65, and driving current is supplied to the coil 41 of the vibration mechanism unit 6 in accordance with the timing and cycle of the first drive pulse P1 and the second drive pulse P2 included in the complex driving signal D5.

When driving is performed with the first drive pulse P1, the vibration mechanism unit 6 is driven at the first natural vibration frequency with a relatively low frequency or a vibration frequency approximate thereto by directing the vibrating body 20 to the X direction, and when driving is performed with the second drive pulse P2, the vibration mechanism unit 6 is driven at the second natural vibration frequency with a relatively high frequency or a vibration frequency approximate thereto by directing the vibrating body 20 to the Z direction.

When driving is performed with the first drive pulse P1 of the first driving signal D4*a*, vibration with a relative low frequency occurs in the data sections Ta1, Ta2, Ta3, . . . , and the vibration is transmitted to the case of the portable audio device 1. The vibration with a low frequency is rhythmically transmitted to the hand holding the case in accordance with the timing when the bass guitar in the reproduced sound of the music information D0 is performed.

When driving is performed with the second drive pulse P2 of the second driving signal D4*b*, vibration with a relative high frequency occurs in the data sections Tb1, Tb2, Tb3, . . . , and the vibration is transmitted to the case of the portable audio device 1. The vibration with a high frequency is rhythmically transmitted to the hand holding the case in accordance with the timing when the drum in the reproduced sound of the music information D0 is performed.

Furthermore, as shown in FIG. 100, when the data sections Tb1, Tb2, Tb3, . . . and the data sections Ta1, Ta2, Ta3, . . . overlap each other in terms of time, driving at the second drive pulse P2 with a high frequency is preferentially performed, and thus, the hand holding the case can feel as if the vibration in accordance with the performance timing of the bass guitar and the vibration in accordance with the performance rhythm of the drum are simultaneously transmitted.

In the vibration generator, since the vibration mechanism unit 6 is driven at the first natural vibration frequency or a vibration frequency approximate thereto, and driven at the second natural vibration frequency or a vibration frequency approximate thereto, it is possible to obtain rhythmical and extensive vibration from the vibration mechanism unit 6. In addition, it is possible to transmit vibration of upbeat rhythm with a high frequency to the hand holding the case by the second natural vibration frequency with a high frequency, to transmit vibration of downbeat rhythm with a low frequency to the hand holding the case by the first natural vibration frequency with a low frequency, whereby vibration giving a feeling corresponding to two kinds of musical instruments can be generated.

In addition, it is possible to variously set the timing for selecting the first drive pulse P1 and the second drive pulse P2 by the selection circuit 60 shown in FIG. 8.

As shown in FIGS. 10A and 10B, for example, when the data sections Ta1, Ta2, Ta3, . . . in which the first drive pulse P1 is included and the data sections Tb1, Tb2, Tb3, . . . in which the second drive pulse P2 is included overlap each other in terms of time, it is possible to cause the data sections Ta1, Ta2, Ta3, . . . , and the data sections Tb1, Tb2, Tb3, . . . , not to overlap each other or set an overlapping time to be as short as possible by slightly delaying either time of the data sections Ta1, Ta2, Ta3, . . . , or the data sections Tb1, Tb2, Tb3, . . . .

Even if the data sections Ta1, Ta2, Ta3, . . . , or the data sections Tb1, Tb2, Tb3, . . . is delayed for a short time, there is a slight time difference between the reproduced sound emitted from the speaker 54 and the vibration, however, the time difference of such a degree is not felt by a human hand.

Figure 11A:
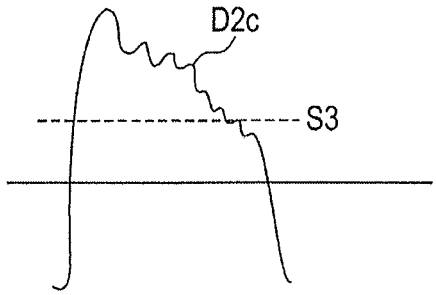
FIGS. 11A to 11C are waveform diagrams showing another operation example of the conversion circuit.
Figure 11B:
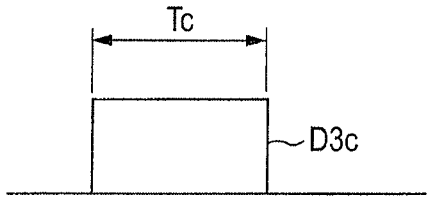
Figure 11C:
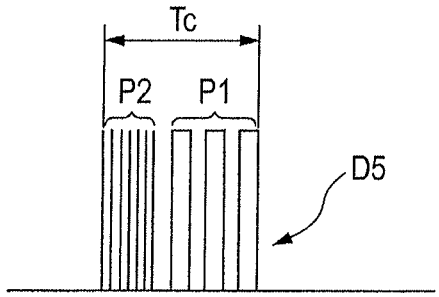

Next, in the examples shown in FIGS. 11A to 11C, sound data D2*c* is extracted from the music information D0 by the band-pass filter. The sound data D2*c* shown in FIG. 11A has a relatively long sound-producing time and is extracted from a band including a register of a musical instrument, such as a cymbal, a trombone, and a horn, having acoustical resonance. In the drive circuit unit 7, only the sound data D2*c* may be extracted, or the sound data D2*c* and the sound data of different register of musical instruments such as a bass guitar and a drum may be simultaneously extracted.

The voltage comparison circuit compares amplified sound data D2*c* and the reference voltage S3, and as shown in FIG. 11B, comparison data D3*c* showing a data section Tc having higher voltage than the reference voltage S3 is obtained. Then, as shown in FIG. 11C, the pulse conversion circuit outputs the first drive pulse P1 and the second drive pulse P2 within the period of the data section Tc in a mixed manner. Accordingly, it is possible to drive the vibrating body 20 of the vibration mechanism unit 6 at a frequency in which the first natural vibration frequency and the second natural vibration frequency are mixed within one data section Tc.

As shown in FIG. 11C, for example, the second drive pulse P2 with a high frequency is generated first in the data section Tc, the first drive pulse P1 with a low frequency is generated in the latter half of the data section Tc, and whereby a slight impact is first given in accordance with the reproduction of the sound of a cymbal, a trombone, a horn, or the like, and then, vibration that leaves continuous resonance of a low frequency can be generated.

In addition, the drive circuit unit 7 shown in FIG. 7 extract different sound data pieces from the analog music information D0 obtained from the audio amplifier 51 by using the band-pass filters 55*a* and 55*b*, however, database obtained by digitalizing the reproduced sound of live music, for example, database recorded on, for example, a CD or a memory can be used as a sound source. In this case, in a sound data extraction unit, digital data of a register corresponding to each musical instrument is extracted by a digital processing unit, and further, a data section exceeding a certain level of sound volume is extracted, and then the first drive pulse P1 or the second drive pulse P2 are generated by the pulse conversion circuit within the data section.

Furthermore, in this embodiment, the magnetic drive unit 40 is used as a drive unit for causing the vibration body 20 to vibrate, however, the drive unit may use a driving method other than a magnetic driving method of a piezoelectric element or the like. In this case, the vibrating body 20 does not have to necessarily be formed of a magnetic metal material.

In addition, the vibration mechanism unit 6 is not limited to installment in the case of the portable audio device 1, and can be installed in the case of a game device, a remote controller, earphones, and the like.

It should be understood by those skilled in the art that various modifications, combinations, sub-combinations and alterations may occur depending on design requirements and other factors insofar as they are within the scope of the appended claims of the equivalents thereof.

What is claimed is:

1. A vibration generator comprising:

a vibration mechanism unit including a vibrating body having a predetermined mass, an elastic support member that supports the vibrating body, and a drive unit that exerts a vibration force on the vibrating body; and a drive circuit unit that drives the vibration mechanism unit, wherein the drive circuit unit includes a sound data extraction unit that extracts sound data of any musical instrument from music information in which sound data of a plurality of musical instruments is mixed, a section extraction unit that extracts, from the extracted sound data, a data section in which a level is equal to or higher than a predetermined value or exceeds the predetermined value, and a pulse conversion unit that outputs, during the extracted data section, a drive pulse of a certain frequency for driving the vibrating body at a natural vibration frequency or at a vibration frequency approximate thereto, wherein the music information is analog information, and the sound data extraction unit is a band-pass filter that extracts sound data a frequency of which corresponds to any musical instrument, wherein the vibration mechanism unit has the vibrating body that vibrates at a plurality of natural vibration frequencies, the sound data extraction unit individually extracts sound data of the plurality of musical instruments from the music information, and the pulse conversion unit prepares a plurality of drive pulses for driving the vibrating body at a different natural vibration frequency or at a vibration frequency approximate to the different natural vibration frequency, whereby different drive pulses are output to each data section among a plurality of data sections obtained from different sound data pieces.

2. The vibration generator according to claim 1, wherein a selection unit is provided, which selects a drive pulse with any one frequency and imparts the pulse to the vibration mechanism unit when the plurality of data sections in which drive pulses with different frequencies are generated to overlap each other.

3. The vibration generator according to claim 2, wherein a selection unit is provided, which delays the time of a drive pulse with any one frequency and imparts the pulse to the vibration mechanism unit when the plurality of data sections in which drive pulses with different frequencies are generated to overlap each other.

4. The vibration generator according to claim 3, wherein the vibration mechanism unit includes the vibrating body that vibrates at different natural vibration frequencies according to the deformation direction of the elastic support member.

5. The vibration generator according to claim 1, wherein a selection unit is provided, which delays the time of a drive pulse with any one frequency and imparts the pulse to the vibration mechanism unit when the plurality of data sections in which drive pulses with different frequencies are generated to overlap each other.

6. The vibration generator according to claim 1, wherein the vibration mechanism unit includes the vibrating body that vibrates at different natural vibration frequencies according to the deformation direction of the elastic support member.

7. A vibration generator comprising:

a vibration mechanism unit including a vibrating body having a predetermined mass, an elastic support member that supports the vibrating body, and a drive unit that exerts a vibration force on the vibrating body; and a drive circuit unit that drives the vibration mechanism unit, wherein the drive circuit unit includes a sound data extraction unit that extracts sound data of any musical instrument from music information in which sound data of a plurality of musical instruments is mixed, a section extraction unit that extracts, from the extracted sound data, a data section in which a level is equal to or higher than a predetermined value or exceeds the predetermined value, and a pulse conversion unit that outputs, during the extracted data section, a drive pulse of a certain frequency for driving the vibrating body at a natural vibration frequency or at a vibration frequency approximate thereto, wherein the music information is digital information, and the sound data extraction unit is a digital processing unit that extracts digital data that is sound data corresponding to any musical instrument, and wherein the vibration mechanism unit includes the vibrating body that vibrates at a plurality of natural vibration frequencies, the sound data extraction unit individually extracts sound data of a plurality of musical instruments from the music information, and the pulse conversion unit prepares a plurality of drive pulses for driving the vibrating body at a different natural vibration frequency or at a vibration frequency approximate to the different natural vibration frequency, whereby different drive pulses are output to each data section among a plurality of data sections obtained from different sound data pieces.

8. The vibration generator according to claim 7, wherein a selection unit is provided, which selects a drive pulse with any one frequency and imparts the pulse to the vibration mechanism unit when the plurality of data sections in which drive pulses with different frequencies are generated to overlap each other.

9. The vibration generator according to claim 7, wherein a selection unit is provided, which delays the time of a drive pulse with any one frequency and imparts the pulse to the vibration mechanism unit when the plurality of data sections in which drive pulses with different frequencies are generated to overlap each other.

10. The vibration generator according to claim 7, wherein the vibration mechanism unit includes the vibrating body that vibrates at different natural vibration frequencies according to the deformation direction of the elastic support member.

11. A vibration generator comprising:

a vibration mechanism unit including a vibrating body having a predetermined mass, an elastic support member that supports the vibrating body, and a drive unit that exerts a vibration force on the vibrating body; and a drive circuit unit that drives the vibration mechanism unit, wherein the drive circuit unit includes a sound data extraction unit that extracts sound data of any musical instrument from music information in which sound data of a plurality of musical instruments is mixed, a section extraction unit that extracts, from the extracted sound data, a data section in which a level is equal to or higher than a predetermined value or exceeds the predetermined value, and a pulse conversion unit that outputs, during the extracted data section, a drive pulse of a certain frequency for driving the vibrating body at a natural vibration frequency or at a vibration frequency approximate thereto, wherein the vibration mechanism unit includes the vibrating body that vibrates at a plurality of natural vibration frequencies, the sound data extraction unit individually extracts sound data of a plurality of musical instruments from the music information, and the pulse conversion unit prepares a plurality of drive pulses for driving the vibrating body at a different natural vibration frequency or at a vibration frequency approximate to the different natural vibration frequency, whereby different drive pulses are output to each data section among a plurality of data sections obtained from different sound data pieces.

12. The vibration generator according to claim 11, wherein a selection unit is provided, which selects a drive pulse with any one frequency and imparts the pulse to the vibration mechanism unit when the plurality of data sections in which drive pulses with different frequencies are generated to overlap each other.

13. The vibration generator according to claim 12, wherein the vibration mechanism unit includes the vibrating body that vibrates at different natural vibration frequencies according to the deformation direction of the elastic support member.

14. A vibration generator comprising:

a vibration mechanism unit including a vibrating body having a predetermined mass, an elastic support member that supports the vibrating body, and a drive unit that exerts a vibration force on the vibrating body; and a drive circuit unit that drives the vibration mechanism unit, wherein the drive circuit unit includes a sound data extraction unit that extracts sound data of any musical instrument from music information in which sound data of a plurality of musical instruments is mixed, a section extraction unit that extracts, from the extracted sound data, a data section in which a level is equal to or higher than a predetermined value or exceeds the predetermined value, and a pulse conversion unit that outputs, during the extracted data section, a drive pulse of a certain frequency for driving the vibrating body at a natural vibration frequency or at a vibration frequency approximate thereto, wherein the vibration mechanism unit includes the vibrating body that vibrates at a plurality of natural vibration frequencies, and the pulse conversion unit outputs drive pulses with different frequencies in a mixed manner to data sections obtained from one sound data piece, wherein the vibration mechanism unit includes the vibrating body that vibrates at different natural vibration frequencies according to the deformation direction of the elastic support member.

* * * * *